US005642118A

United States Patent [19]

Grannemann

[11] Patent Number: 5,642,118

[45] Date of Patent: Jun. 24, 1997

[54] APPARATUS FOR DISSIPATING ELECTROMAGNETIC WAVES

[75] Inventor: Richard Scott Grannemann, Benbrook, Tex.

[73] Assignee: Lockheed Corporation, Fort Worth, Tex.

[21] Appl. No.: 437,305

[22] Filed: May 9, 1995

[51] Int. Cl.[6] ..... H01Q 17/00

[52] U.S. Cl. ..... 342/4

[58] Field of Search ..... 342/1, 2, 3, 4

[56] References Cited

U.S. PATENT DOCUMENTS

| | | | |
|---|---|---|---|
| 2,771,602 | 11/1956 | Kuhnhold | 342/1 |
| 3,124,798 | 3/1964 | Zinke | 342/4 |
| 3,126,718 | 3/1964 | Flamand | 62/219 |
| 3,233,238 | 2/1966 | Barker | 342/2 |
| 3,307,186 | 2/1967 | Straub | 342/4 |
| 3,348,224 | 10/1967 | McMillan | 342/1 |
| 3,440,655 | 4/1969 | Wesch et al. | 342/1 |
| 3,754,255 | 8/1973 | Suetake et al. | 342/4 |
| 4,107,633 | 8/1978 | Scaletta | 333/81 A |
| 4,118,704 | 10/1978 | Ishino et al. | 342/4 |
| 4,170,010 | 10/1979 | Reed | 342/1 |
| 4,381,510 | 4/1983 | Wren | 342/1 X |
| 4,684,952 | 8/1987 | Munson et al. | 343/700 MS |
| 4,786,915 | 11/1988 | Cartwright et al. | 343/909 |
| 4,947,174 | 8/1990 | Lehman et al. | 342/3 |
| 4,973,963 | 11/1990 | Kurosawa et al. | 342/4 |
| 5,081,455 | 1/1992 | Inui et al. | 342/1 |
| 5,085,931 | 2/1992 | Boyer, III et al. | 342/1 X |
| 5,110,651 | 5/1992 | Massard et al. | 342/1 X |
| 5,113,190 | 5/1992 | Klein | 342/4 |

*Primary Examiner*—John B. Sotomayor
*Attorney, Agent, or Firm*—James E. Bradley

[57] ABSTRACT

An apparatus for providing broadbanded electromagnetic radiation attenuation is disclosed. The apparatus comprises a surface mount to which a plurality of protuberances are mounted. Each protuberance is further made up of a plurality of impedance sheets that are substantially concentric one with another. The impedance sheets are directionally shaped so as to enhance absorption of any polarization of plane wave radiation from any incidence direction including near grazing incidence. The impedance sheets have impedance values which are tapered with higher impedance values belonging to the sheets farther away from the concentric center. These sheets may be either substantially spherical, hemispherical, or circular cylinders. The distance separating neighboring impedance sheets is selected according to the shortest wavelength for which good electromagnetic attenuation is desired. Further, additional layers of attenuation materials may also be provided, which comprise substantially the same materials as the first layer, namely additional pluralities of protuberances and additional pluralities of directionally shaped impedance sheets.

18 Claims, 3 Drawing Sheets

APPARATUS FOR DISSIPATING ELECTROMAGNETIC WAVES

BACKGROUND OF THE INVENTION

1. Technical Field

The present invention relates generally to shielding from electromagnetic wave transmission and reduction in electromagnetic wave reflection and, more specifically, to dissipating electromagnetic waves using impedance sheets. More particularly still, the present invention relates to absorbing electromagnetic waves, regardless of their angle of incidence, using directionally-shaped impedance sheet absorbers.

2. Description of the Related Art

The ability to attenuate electromagnetic waves incident on a surface material at any angle is useful in many applications. One application is in an anechoic testing chamber used to minimize any reflective electromagnetic waves that would distort the results of the device under test in the chamber. Attenuating material is placed on the floor, the walls, and the ceiling to attenuate any reflective waves interfering with the test results.

It is also useful to use attenuating material to place on an object that is desired to be undetectable to searching electromagnetic waves, such as by radar. This is also desirable to minimize interference with a directional receiver used by the object.

Previous solutions have included using planar impedance sheets that use a thin film of conductive material or using an electrically thick layer of electrically or magnetically lossy bulk materials. Additionally, these planar devices have been stacked one upon another in an attempt to increase the absorption bandwidth. Also, carbon loaded core and pyramidal carbon loaded foam have been used as absorbing devices.

Unfortunately, these prior solutions have had limited success. For example, the use of thin planar impedance sheets provides only poor absorption for certain directions and polarizations of the incident electromagnetic radiation. Furthermore, the absorption of impinging electromagnetic waves by electrically thick planar layers of electrically or magnetically lossy bulk materials is inherently limited by the departure of the material's permitivity and permeability from that of air. Also, the granular nature of many absorbers (such as foams) have poor performance in the higher range of electromagnetic frequencies at which the granular nature of the underlying material can be seen by the shorter wavelengths. Additionally, those sheets made from magnetically lossy material are not lightweight, which is desirable in many electromagnetic absorption situations. In addition, pyramidal foam absorbers are bulky, structurally weak, and not easily incorporated into composite structure. Furthermore, all of these prior solutions have poor absorbing properties near grazing incidence.

Accordingly, what is needed is an apparatus for attenuating incident electromagnetic radiation for all polarizations and directions of incidence without using thick material layers or magnetic materials. Further, what is needed is an apparatus for attenuating electromagnetic radiation that is lightweight in construction and covers a broadbanded absorption range, including good absorption near grazing incidence.

SUMMARY OF THE INVENTION

It is therefore one object of the present invention to provide shielding from electromagnetic wave transmission.

It is another object of the present invention to reduce electromagnetic wave reflection.

It is yet another object of the present invention to provide an apparatus that dissipates electromagnetic waves using impedance sheets.

It is still another object of the present invention to provide an apparatus that absorbs electromagnetic waves, regardless of their angle of incidence and polarization using directionally-shaped impedance sheet absorbers.

The foregoing objects are achieved as is now described. According to the present invention, an apparatus for providing electromagnetic radiation attenuation is disclosed. The apparatus comprises a surface mount to which a plurality of protuberances are mounted where the protuberances are arranged in such a manner as to attenuate electromagnetic radiation impinging on the apparatus from virtually any direction of incidence. Each protuberance is further made up of a plurality of directionally shaped impedance sheets that are substantially concentric one with another. Each sheet in a protuberance has an approximately constant impedance value over the sheet. The impedance values of the multiple sheets in a protuberance are tapered with lower values of impedance belonging to sheets with distances closer to the point or axis of concentricity. The sheets may be either substantially spherical or circular cylinders or cylinders of arbitrary cross-section. The spacing between the sheets is partially based on the wavelength of the electromagnetic radiation to be attenuated. Further, additional layers of attenuation materials may also be provided, which comprise substantially the same materials as the first layer, namely additional pluralities of protuberances and additional pluralities of directionally shaped impedance sheets.

The impedance sheets may be coupled in such a manner as to allow flexibility so that the attenuation apparatus can assume the shape of the surface to which they are attached. Additionally, the space between the impedance sheets may be air, a material that has the permitivity and permeability close to that of air, or any other material. In particular, the space between the impedance sheets may be a material having magnetic or electric loss.

One application of the electromagnetic attenuation apparatus is to use it in such a structure as an anechoic chamber. The anechoic chamber typically has a floor, ceiling, and a plurality of walls. The electromagnetic attenuation apparatus covers the floor, ceiling, and walls of the chamber to reduce the interference of these surfaces with the measurements conducted within.

Another application of the device is to incorporate it into lightweight composite structure for the purpose of shielding or attentuation of electromagnetic waves.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
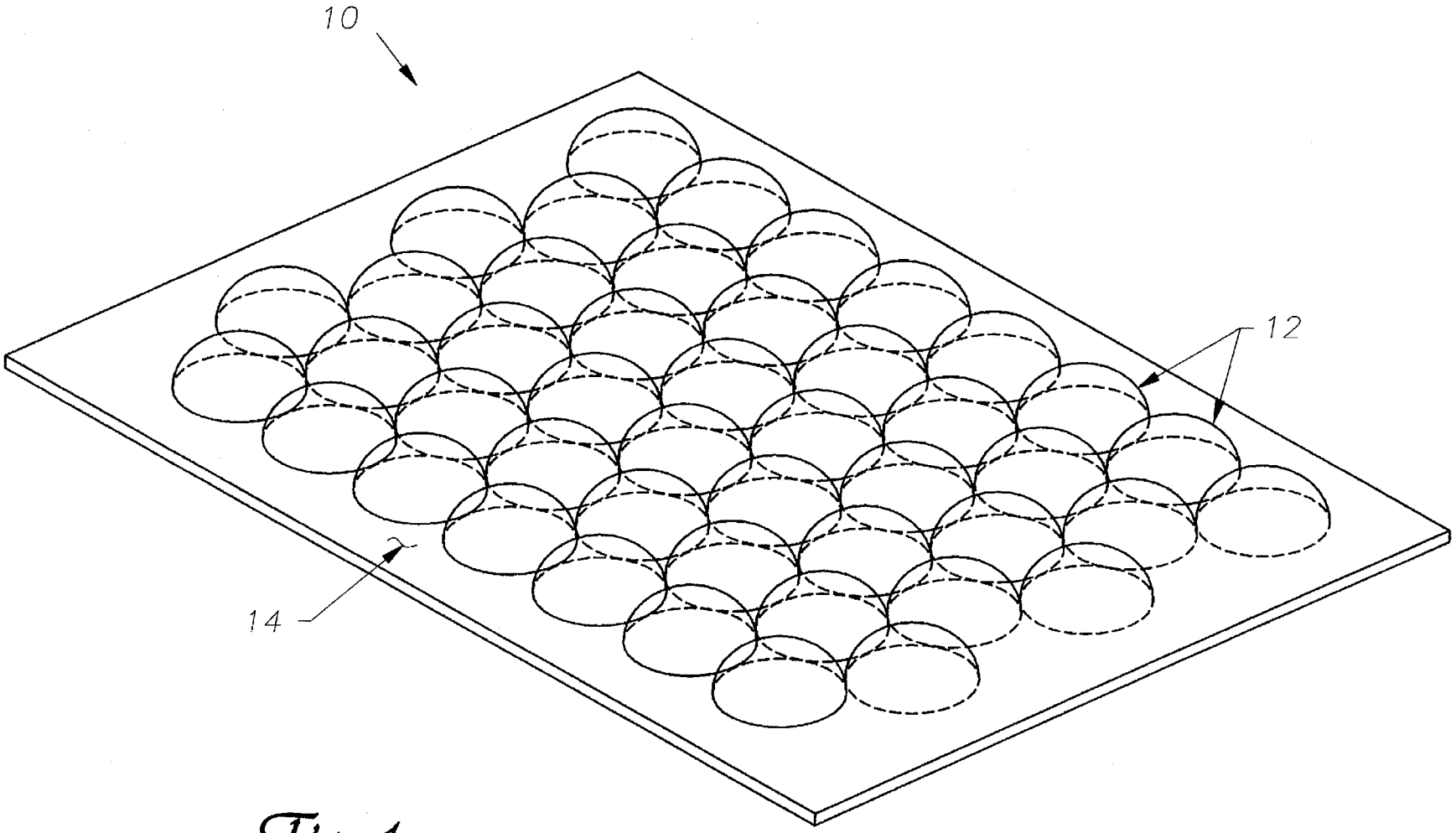
FIG. 1 depicts a preferred embodiment of the present invention given the denotation "bubble absorber".

FIG. 1 illustrates a perspective view of an electromagnetic attenuation apparatus 10 according to the present invention. This embodiment of the invention is referred to as "bubble absorber". Apparatus 10 includes a plurality of protuberances or absorbing bubbles 12, which are mounted to a ground plane 14. The plurality of bubbles 12 are mounted to the ground plane 14 in such a fashion so as to cover as much of the surface area of the ground plane 14 as is possible.

FIG. 1 further shows two possible polarizations of plane-wave electromagnetic radiation incident from a given elevation and azimuth angle. Since bubbles 12 are generally spherical in shape, the arrangement of bubbles 12 allow for the electric field vector $\overline{E}$ of the impinging electromagnetic field to lie tangent to a portion of the surface of each bubble in the ensemble giving rise to the good absorptive properties of the invention. Since the electric field vector of plane-wave radiation is always orthogonal to the direction of incidence, the electric field vector will be tangent to a portion of the surface of each bubble for any polarization and direction of incidence. In particular, this tangential relationship between the electric field and the bubble's impedance sheets will continue to hold near grazing incidence angles.

Figure 2:
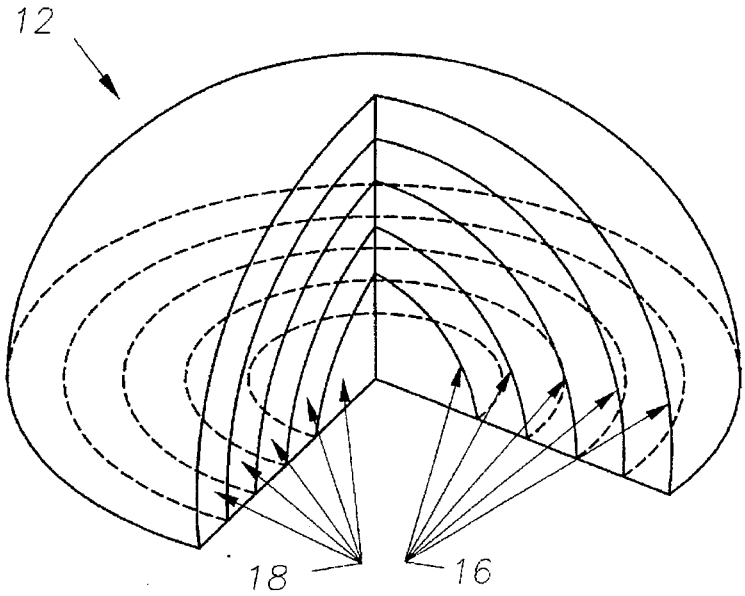
FIG. 2 is a cross-sectional schematic of bubble absorber.

The electromagnetic wave-absorbing bubbles 12, arrayed side by side on ground plane 14, are further depicted in a cutaway perspective view in FIG. 2. Each bubble 12 is made up of a plurality of concentric shells consisting of hemispherically shaped impedance sheets 16. Sandwiched between each sheet 16 is either air or a desired filler material 18, such as, for example, styrofoam or carbon-fiber imbedded foam. In the example of FIG. 2, there are five impedance sheets, but as few as one impedance sheets would be required and as many impedance sheets as desired are also possible. The concentric shells may be either spherical, nearly spherical, elliptical, or egg-shaped. They also may be full spheres rather than hemispheres.

Each shell in a bubble is made of an impedance sheet material that can be characterized electrically as a complex impedance in units of ohms per square. The unique absorbing properties of the invention are achieved by shaping all the shells in every bubble so that the electric field vector of incident plane polarized radiation will be tangent to a large portion of impedance sheet surfaces regardless of incident radiation direction. It is to be noted that loaded honeycomb core designs, even those with novel impedance grading schemes, fail to orient the individual impedance sheets in the core in a manner to present them in the plane of the incident electric field vector over broad ranges of incidence angle.

The constant impedance values of the individual shells typically are tapered (using, for example, a linear or quadratic relationship) with respect to the distance of the shell from the bubble's center with the higher impedance values belonging to the shells farther from the bubble's center. Impedance values may also vary within a single impedance sheet shell.

The use of multiple shells in each bubble with impedance values tapered from the center promotes broadbanded absorption. Better absorption is obtained when the distance between the first and the last impedance shells is a half wavelength or longer. The distance between a shell and its nearest neighbor should be a fraction of a wavelength, in general, ¼ wavelength or shorter. Many variations of shell spacing and impedance values are possible. Impedance values may also vary within a single shell. A typical design might be a two wavelength diameter spherical bubble with impedance shells spaced every tenth of a wavelength with impedance values tapered quadratically beginning at 1500 phms per square for the outermost shell and 300 ohms per square for the innermost shell.

The bubbles 12, in FIG. 1, may be encased in a material or surrounded by a skin to give the device added strength or durability.

Figure 3:
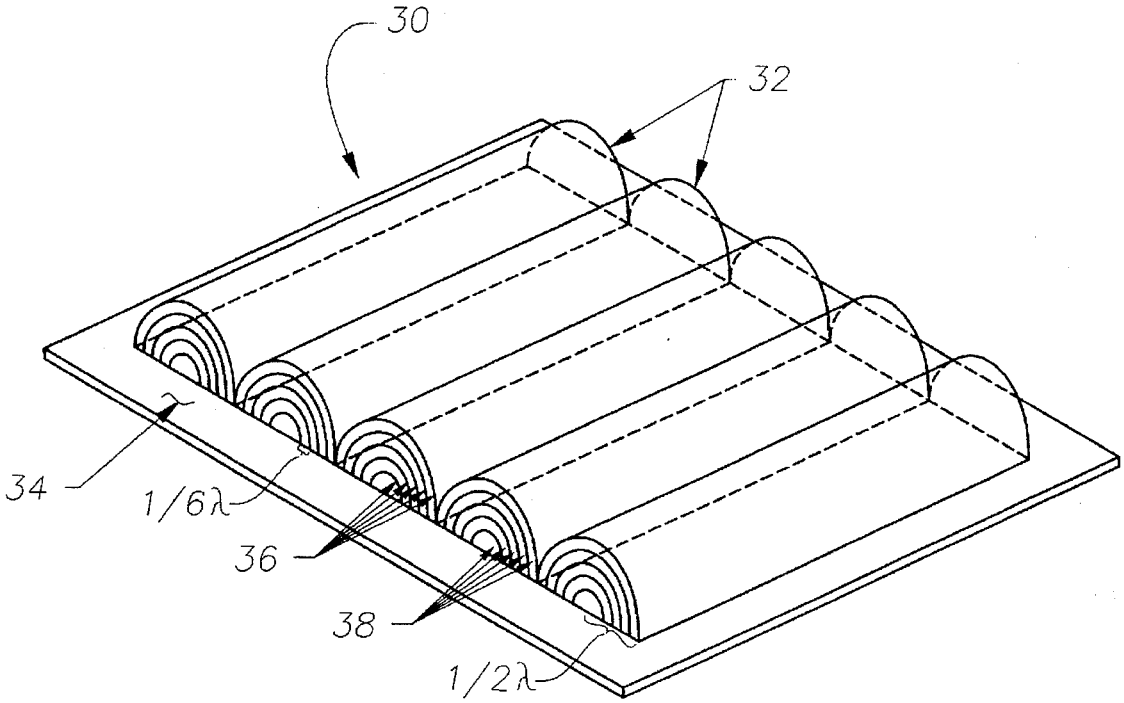
FIG. 3 depicts a preferred embodiment of the present invention given the denotation "tubular absorber".

A second embodiment of the present invention is illustrated in FIG. 3. This embodiment of the invention is called "tubular absorber". Tubular absorber 30 consists of electromagnetic wave-absorbing protuberances or tubes 32 arrayed side by side on a ground plane 34. Each tube 32 consists of concentric, or approximately concentric, shells 36 with semi-circular, or approximately semi-circular, cross-sections separated by air or filler material 38. The cross-section may also be full circles rather than semi-circles.

Each shell 36 in a tube 32 is made of impedance sheet material that can be characterized electrically by a complex impedance in units of ohms per square. The constant impedance values of the individual shells are typically tapered, as in the case of spherical shells of FIG. 2, (using, for example, a linear or quadratic relationship) with respect to the distance of the shell from the center axis of the tube with the higher impedance values belonging to the shells farthest away from the center axis. Impedance values may also vary within a single impedance sheet shell.

The principle of operation of the tubular absorber implementation in FIG. 3 is similar to the bubble absorber implementation in FIG. 1 except that in FIG. 3 the preferred direction for incident radiation is at angles normal to the tubes' axes rather than at arbitrary angles. However, absorption at incident angles other than normal to the tubes' axes may also be good. For the incident angles normal to the tubes' axes, the circular shape of the impedance sheets keeps the electric field vector of plane-polarized incident radiation tangent to a portion of the surface of each impedance sheet in each tube as the elevation angle changes, thus, maintaining good conditions for radiation absorption. Note that these conditions are maintained even for near grazing incidence angles. The use of several shells in each tube with impedance values tapered from the center promotes broadbanded absorption, as in the case with the spherical shells.

One preferred embodiment places the distance between the first and last impedance shell at least a half wavelength or longer of the intended radiation to be attenuated. Spacing between the impedance shells might be a quarter wavelength or less. Many variations of shell spacing and impedance values are possible.

Further, the tubes may be encased in a material or surrounded by a skin to give the absorber 30 added strength or durability.

Figure 4:
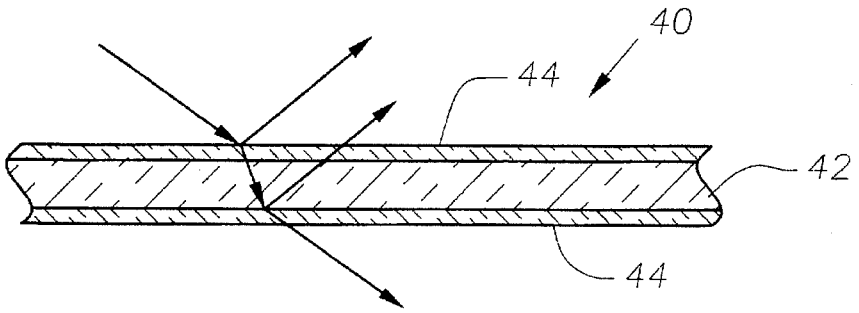
FIG. 4 is a cross-sectional schematic of an impedance sheet.

FIG. 4 depicts a cross sectional view of an impedance sheet 40 out of which bubble absorber or tubular absorber might be made. A base layer 42 is provided, which base layer 42 may be made from a material such as, for example, Kapton or other similar material upon which a thin layer 44 of metal or some other conductive material may be applied. The conductive material may be applied on one or both sides so as to give the sheet the desired ohms per square value.

The thickness of the base material can be chosen so thin with respect to wavelength, limited only by mechanical considerations, as to give the base material (without the application of the conductive material) arbitrarily high transmission and arbitrarily low reflection properties. This fact makes it possible for the present invention to exceed the performance of any bulk material absorbing design.

If the impedance shells of the bubbles are thin with air in the space between, then the potential exists to reduce electromagnetic reflections below that which is possible using bulk absorbing materials for the following reason. Since the shells are thin, reflection from the outer shell in the bubble can be made arbitrarily small by increasing its impedance (since the base material is thin and the shell is backed by air). In contrast, reflection from any design using bulk materials cannot be arbitrarily reduced since it will be held up by the fact its bulk permitivity or permeability, or both, differ from that of air. It is therefore possible for an optimally designed array of concentric impedance shells with air in the space between to produce reflections lower than what is possible with bulk absorber designs. High frequency performance will also not be impaired due to any bulk granular material properties.

Figure 5:
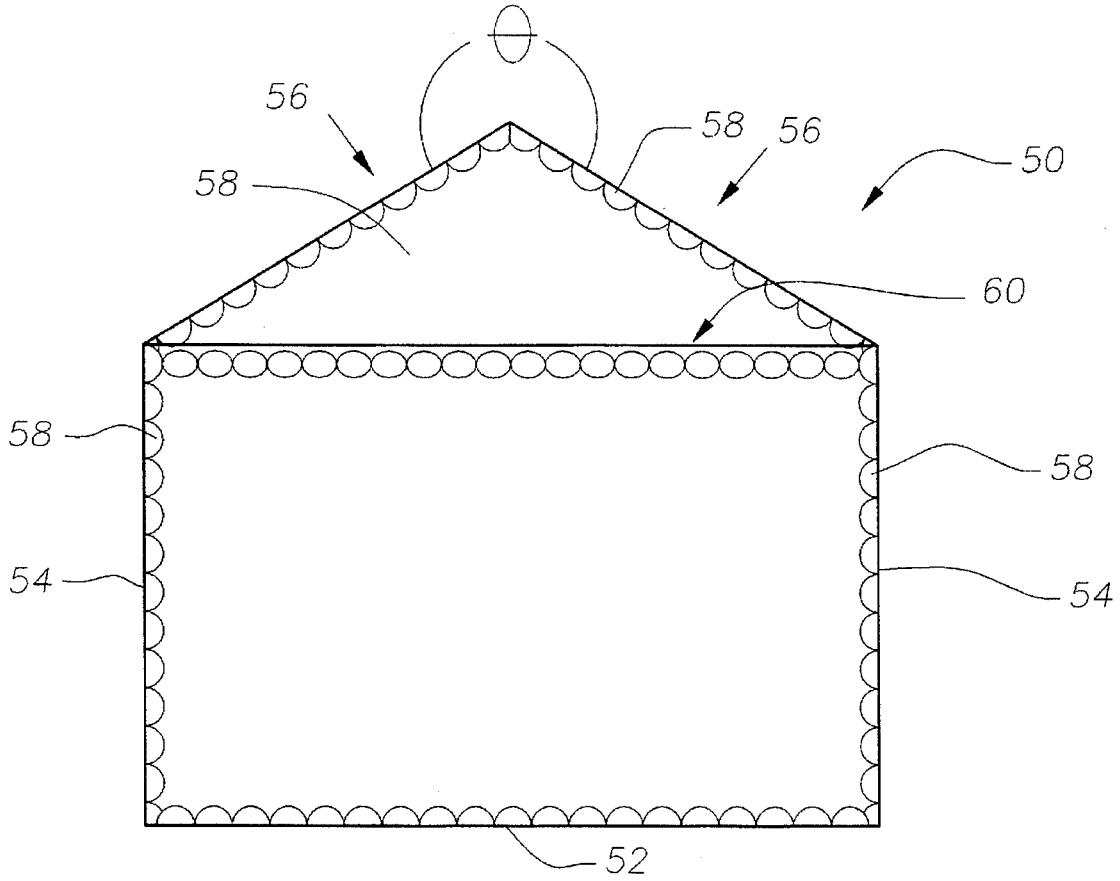
FIG. 5 depicts absorber placement in an anechoic chamber (top view).

FIG. 5 is an illustration of an application of electromagnetic wave absorbers in an anechoic chamber 50. Shown is the top view of an anechoic chamber in which a bubble or tubular absorber has been applied. Chamber 50 includes four walls, a front wall 52 near to where the radar is located, two side walls 54, and a back wall 56 near to where the target is located. The back wall is given a "v" shape so that radiation from the radar does not impinge on the wall in a direction normal to the ground plane holding the bubble or tubular absorber since the absorber performs best at off normal angles of incidence. It is noted that traditionally used pyramidal absorber performs best at normal incidence. The back wall using this type of absorber is usually flat 60 rather than "v" shaped.

Although the present invention illustrates an example of the electromagnetic attenuation sheet being applied to an anechoic chamber, other uses of the invention are also possible. For example, the sheets may be attached to an object on its exterior surface or incorporated into composite structure so as to minimize any reflective signal back to an electromagnetic scanning device, such as a radar system. Variations of the device would also be useful in microwave circuits or integrated circuits and microwave or laser devices and systems to reduce electromagnetic interference.

While the invention has been shown in only one of its forms, it should be apparent to those skilled in the art that it is not so limited, but is susceptible to various changes without departing from the scope of the invention.

I claim:

1. An electromagnetic radiation attenuation apparatus comprising:

a surface mount; and a plurality of protuberances, mounted to said surface mount and arranged in such a manner as to attenuate incident electromagnetic radiation impinging said protuberance;

each of said protuberances having a plurality of thin curved impedance sheets mounted substantially concentric with each other, said impedance sheets being spaced apart from one another by gaps; and each of said impedance sheets having a substrate which has high transmission and low reflection properties and which is coated with a conductive layer which has a selected electrical impedance value and which is partially penetrable to impinging radiation.

2. The apparatus according to claim 1 wherein said impedance values of said impedance sheets are gradually reduced a largest impedance value being farthest from a point of concentricity a smallest impedance value being closest to said point of concentricity.

3. The apparatus according to claim 1 wherein said surface mount is planar.

4. The apparatus according to claim 1 wherein said impedance sheets have partially spherical configurations.

5. The apparatus according to claim 1 wherein said impedance sheets are substantially hemispheres.

6. The apparatus according to claim 1 wherein said impedance sheets have partially cylindrical configurations.

7. The apparatus according to claim 1 wherein said gaps have permitivity and permeability values substantially the same as air.

8. The apparatus according to claim 1 wherein said surface mount is electrically conductive.

9. An apparatus for providing electromagnetic radiation attenuation comprising:

an electrically conductive surface mount;

a plurality of protuberances arranged on the surface mount adjacent one another in such a manner as to cover a given surface area of the surface mount;

each of said protuberances having a plurality of directionally shaped curved, thin impedance sheets arranged to fit substantially concentrically within one another about a point of concentricity;

said impedance sheets being spaced apart from one another by gaps;

each of said impedance sheets having a substrate which has high transmission and low reflection properties and which is coated with a conductive layer which has a selected electrical impedance value and which is partially penetrable to impinging radiation; and said impedance values of said impedance sheets being gradually reduced from said impedance sheet farthest from said point of concentricity to said impedance sheet closest to said point of concentricity.

10. The apparatus according to claim 9 wherein said surface mount is planar.

11. The apparatus according to claim 9 wherein said gap has a thickness no greater than a quarter wave length of said electromagnetic radiation to be attenuated.

12. The apparatus according to claim 9 wherein said impedance sheets have configurations which are partially spherical.

13. The apparatus according to claim 12 wherein said impedance sheets have configurations which are partially cylindrical.

14. The apparatus according to claim 9 wherein the distance between said impedance sheet farthest from said point of concentricity and said impedance sheet closest to said point of concentricity is greater than one-half wavelength of the radiation to be attenuated.

15. The apparatus according to claim 14 wherein the thicknesses of said gaps are less than a wavelength of the radiation to be attenuated.

16. The apparatus according to claim 9 wherein said gaps comprise air.

17. The apparatus according to claim 9 wherein said gaps comprise a material with permitivity and permeability close to that of air.

18. An apparatus for providing electromagnetic radiation attenuation comprising:

a substantially planar surface mount of electrically conductive material;

a plurality of protuberances arranged on the surface mount adjacent one another in such a manner as to cover a given surface area of the surface mount;

each of said protuberances having a plurality of directionally shaped curved, thin impedance sheets arranged to fit substantially concentrically within one another about a point of concentricity, the distance between said impedance sheet farthest from said point of concentricity and said impedance sheet closest to said point of concentricity being greater than one-half wavelength of the radiation to be attenuated;

said impedance sheets being spaced apart from one another by gaps which have substantially the same permitivity and permeability as air, said gaps having thicknesses less than a wavelength of the radiation to be attenuated;

each of said impedance sheets having a substrate which has high transmission and low reflection properties and which is coated with a conductive layer which has a selected electrical impedance value and which is partially penetrable to impinging radiation; and said impedance values of said impedance sheets being gradually reduced from said impedance sheet farthest from said point of concentricity to said impedance sheet closest to said point of concentricity.

* * * * *